US005672872A

United States Patent [19]

Wu et al.

[11] Patent Number: 5,672,872

[45] Date of Patent: Sep. 30, 1997

[54] FLIR BORESIGHT ALIGNMENT

[75] Inventors: Yeong-Wei A. Wu, Rancho Palos Verdes; David F. Hartman, Chatworth; Mark Youhanaie, Playa Del Rey, all of Calif.

[73] Assignee: Hughes Electronics, Los Angeles, Calif.

[21] Appl. No.: 618,646

[22] Filed: Mar. 19, 1996

[51] Int. Cl.[6] ..... F41G 1/54

[52] U.S. Cl. ..... 250/330

[58] Field of Search ..... 250/330

[56] References Cited

U.S. PATENT DOCUMENTS

| | | | |
|---|---|---|---|
| 5,202,829 | 4/1993 | Geier | 364/449 |
| 5,245,909 | 9/1993 | Corrigan et al. | 89/41.19 |

OTHER PUBLICATIONS

A1-F18AC-744-100, "Organizational Maintenance, Principles of Operation, Description, Forward Looking Infrared System," pp. 1-8. (Jun. 1, 1989).

Description of F/A-18 Detecting Set, pp. 1-1 -4-37.

Kalman, R.E., "A New Approach to Linear Filtering and Prediction Problems," *Journal of Basic Engineering*, pp. 35-45, Mar., 1960.

*Primary Examiner*—Constantine Hannaher

*Attorney, Agent, or Firm*—Gordon R. Lindeen, III; Michael W. Sales; Wanda K. Denson-Low

[57] ABSTRACT

A FLIR boresight alignment system (52) for aligning a sensor pod LOS associated with a weapons pod of a fighter aircraft to a navigation reference frame. A pod inertial navigation and global positioning system (62) provides position, velocity and attitude of a sensor (58) within the pod. An aircraft inertial navigation and/or global positioning system (68) provides position, velocity and attitude of the aircraft. The sensor position and velocity and the aircraft position and velocity are applied to a transfer alignment filter (64) that utilizes Kalman filtering. An output of the transfer alignment filter (64) is applied to a sensor inertial navigation system to correct the pod LOS relative to the navigation reference frame. Alternately, the transfer alignment filter (64) may operate directly upon the pseudo ranges and delta pseudo ranges to satellites being tracked by the GPS receiver.

21 Claims, 4 Drawing Sheets

$\hat{x}(0|0)=0$ $k=0,1,\ldots$

FLIR BORESIGHT ALIGNMENT

BACKGROUND OF THE INVENTION

1. Field of the Invention

This invention relates generally to a boresight alignment scheme for target detection and tracking and, more particularly, to a forward-looking infrared (FLIR) boresight alignment scheme that aligns a sensor boresight to a set of navigation coordinates using a GPS/INS system and a Kalman filter algorithm.

2. Discussion of the Related Art

State of the art military fighter aircraft use some form of target location system to detect and track a target or targets so as to aim the weapons of the aircraft at the target to increase the probability that the target will be hit. FIG. 1 generally depicts a fighter aircraft 10, such as an F-18, currently being used by the United States Military. The aircraft 10 includes a number of missiles and/or guided weapons 12 secured beneath wings 14 and a fuselage 16 of the aircraft 10. Control of the aircraft 10 is performed by a pilot (not shown) within a cockpit 18 of the aircraft 10. The aircraft 10 will include some form of weapons guidance system readable within the cockpit 18 that causes the weapons 12 to be directed to a target or targets (not shown) as controlled by the pilot of the aircraft 10.

FIG. 2 depicts a pod 20 associated with a known forward-looking infrared (FLIR) weapons guidance system. The FLIR system provides real-time, passive thermoimagery, in a television format, for detection and identification of tactical targets under conditions of daylight or darkness. The FLIR system is capable of automatically tracking selected targets on command and providing accurate line-of-side (LOS) pointing angles and angular rates of the pod 20 to an aircraft mission control computer (not shown). The pod 20 is secured to the underside of the fuselage 16 of the aircraft 10 by a supporting structure 22.

The pod 20 houses various components of the FLIR system. These components include an optics-stabilizer 26 and an infrared receiver section 28 that represents the sensor of the FLIR system. The optics-stabilizer 26 includes a pitch and yaw stabilizer sight assembly (not shown). The sight assembly is inertially stabilized by a pitch and yaw gyro/gimbal assembly. An inner gimbal assembly controls the yaw travel, and an outer gimbal assembly controls the pitch travel. The sight assembly receives infrared radiation from a scene through an infrared window 30. The optics-stabilizer 26 optically transfers this radiation through to the infrared receiver section 28. The infrared receiver section 28 is attached to and optically interfaces with the optics-stabilizer 26. The infrared receiver section 28 converts the infrared energy from the optics-stabilizer 26 into a composite video signal for subsequent processing.

A pod aft section assembly 32 includes various FLIR components, such as an auto collimator boresight assembly, a roll drive motor, a controller processor and a servo controller (all not shown). The pod aft section assembly 32 is the main structure support for the FLIR pod components. In this particular embodiment, the pod aft section assembly 32 is connected to the aircraft fuselage 16 at four attachment points to provide a structure interface. The auto collimator boresight assembly includes electronic optical elements that produce electrical signals representing optical bench angular position with respect to the position of the pod aft section assembly 32. The controller processor is an analog/digital computer that provides various functions such as input/output functions, central processing functions, and analog processing functions. The FLIR system interfaces with the mission control computer on an avionics multiplexer (not shown). The avionics multiplexer provides a two terminal multiplex data bit bus that enables two way communications between the mission control computer and the controller processor in the pod 20. The roll drive motor rotates the pod head section with respect to the pod aft section assembly 32. A power supply system 34 provides power to all of the electronic assemblies within the pod 20.

The FLIR system includes many other components necessary for the operation of the system. The operation of a FLIR pod as described above is known in the art, and details of the various components and their operations can be found in various references such as the paper, "Organizational Maintenance Principles of Operation Description Forward-Looking infrared System," Jun. 1, 1989.

FIG. 3 depicts a navigation reference frame that defines the orientation of the aircraft 10 in cartesian coordinates for the aircraft mission control computer. The orientation of the navigation reference frame relative to a navigation frame is determined by an aircraft inertial navigation system (INS) (not shown). An aircraft INS is a well known device for giving aircraft position, velocity and attitude. The INS gives the aircraft reference position to the mission control computer. In order for the weapons 12 to be accurately guided to the target, its location must be determined by the FLIR system; precision alignment between the pod LOS and the navigation reference frame is necessary. For current state of the art systems, this alignment must be within 1 milli-radian per axis, 1 sigma.

For current FLIR systems, the alignment between the pod LOS and the navigation reference frame is maintained through the use of three alignment procedures. These alignment procedures include IR boresight alignment, autocollimator boresight alignment, and aircraft active boresight alignment. FIG. 4 depicts a pod 40 intended to represent the pod 20, above. The orientation of the pod 40 is defined by a pod mounting reference frame 42 in cartesian coordinates. The pod LOS is defined by an LOS reference frame 44, and the IR boresight alignment of the sensor is defined by an IR reference frame 46. Various alignment procedures are used to compensate for pod sight line reference errors caused by flexure of aircraft structural elements, such as the aircraft wings 14 and the aircraft fuselage 16, the removing and replacing of FLIR pod assemblies, IR receiver scan drift errors and changes with time. The autocollimator detects optical bench angular positions, i.e., pitch and yaw errors between the IR receiver (sensor) and a reference formed by the FLIR pod mounting points.

In order to align the pod LOS represented by the LOS reference frame 44 to the navigation reference frame, the prior art systems first aligned the pod LOS to the IR reference frame 46 to provide IR boresight alignment. Next, the IR reference frame 46 was aligned to the pod mounting reference frame 42 to provide autocollimator boresight processing and alignment. Then, the pod mounting reference frame 42 was aligned to the navigation reference frame to provide aircraft active boresight alignment. The aircraft structural flexing between the pod mounting reference frame 42 and the aircraft body reference frame is measured by an active boresight alignment system provided on the aircraft 10. The alignment ($C_{LOS}^{INS}$) of the weapons 12 to the navigation reference frame is then given as:

$$C_{LOS}^{INS}=[C_{MR}^{INS}][C_{IR}^{MR}][C_{LOS}^{IR}]$$

where, $C_{MR}^{INS}$ is the aircraft active boresight;

$C_{IR}^{MR}$ is the auto collimator boresight processing; and $C_{LOS}^{IR}$ is the boresight alignment.

The above described prior art aircraft and weapons alignment scheme includes a number of areas that can be improved upon. The numerous alignment calculations necessary cause errors which reduce the accuracy of the alignment. The various alignment schemes require an extensive amount of hardware, which is space consuming and costly. The aircraft active alignment process requires a time consuming manual alignment procedure which may be eliminated. This procedure also requires the mounting of the pod to a particular station on the aircraft. This mounting restriction may also be eliminated.

What is needed is a FLIR boresight alignment mechanism which can at least improve upon prior art alignment mechanisms in these areas. It is therefore an object of the present invention to provide such a FLIR boresight alignment mechanism.

SUMMARY OF THE INVENTION

In accordance with the teachings of the present invention, a FLIR boresight alignment technique is disclosed for aligning a sensor pod LOS associated with a weapons target detection pod of a fighter aircraft to a navigation reference frame.

In one embodiment, the sensor pod includes a pod inertial navigation system that provides position and velocity signals of a sensor within the pod. An aircraft inertial navigation system provides position and velocity signals of the aircraft. The sensor position and velocity signals and the aircraft position and velocity signals are applied to a transfer alignment filter that includes a Kalman filter. The difference between the sensor position and velocity and the aircraft position and velocity are input to the Kalman filter which can appropriately align the sensor to the navigation reference frame.

In an alternate embodiment, the position and velocity of the sensor is independently determined by a global positioning system receiver. The separate positions of the sensor and the aircraft are then applied to a transfer alignment filter that includes a Kalman filter operating as a cascaded filter. The Kalman filter provides an estimate of the alignment error between the IMU sensor position and the navigation reference coordinates.

The Kalman filter may alternately operate "directly" upon the pseudo ranges and delta pseudo ranges to the satellites tracked by the GPS receiver.

Additional objects, advantages and features of the present invention will become apparent from the following description and appended claims, taken in conjunction with the accompanying drawings.

DETAILED DESCRIPTION OF THE PREFERRED EMBODIMENTS

The following description of the preferred embodiments directed to a FLIR boresight alignment technique is merely exemplary in nature and is in no way intended to limit the invention or its applications or uses.

The present invention proposes modifying the currently existing FLIR boresight alignment technique, as outlined above, to increase its accuracy and response time, and reduce its cost and hardware implementation. To accomplish this goal, the present invention proposes, in one embodiment, to replace the autocollimator and the active structure alignment system in the existing pod 20 with a pod INS, and by using a Kalman filter algorithm to maintain its alignment to a set of navigation coordinates.

Figure 1:
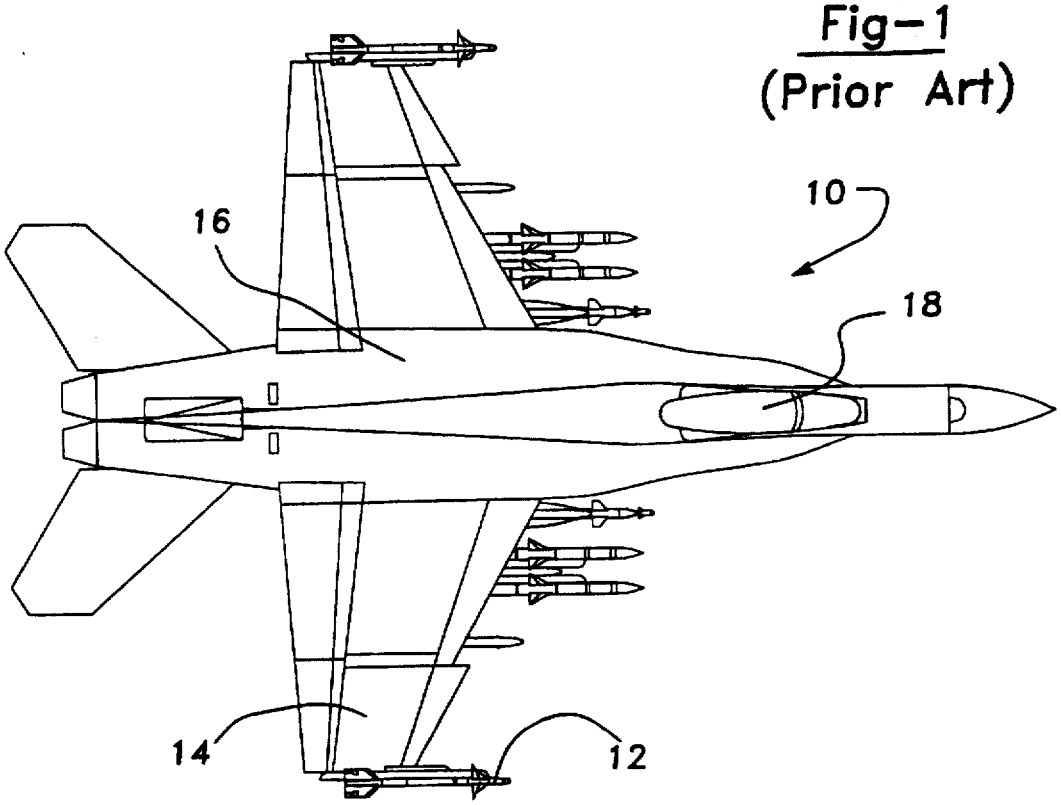
Fig-1 (Prior Art)
FIG. 1 is a perspective view of a military fighter aircraft.
Figure 2:
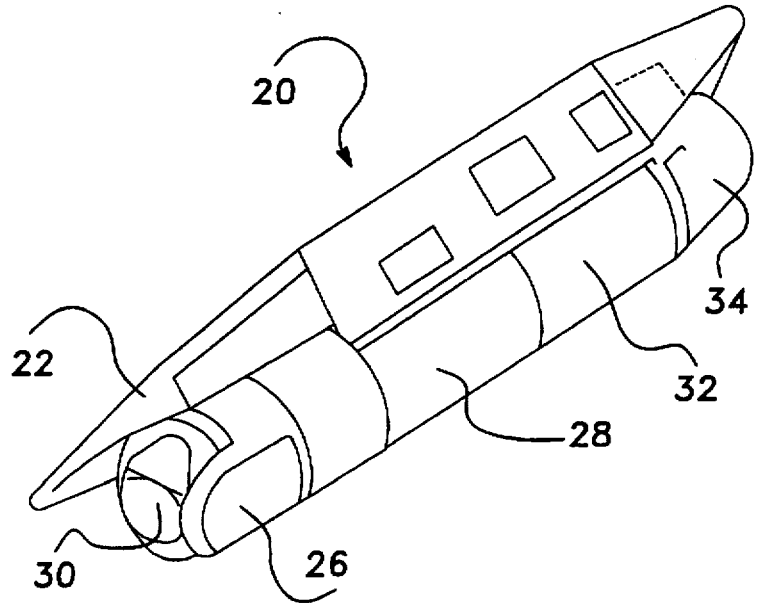
Fig-2 (Prior Art)
FIG. 2 is a perspective view of a prior art pod of an FLIR system.
Figure 3:
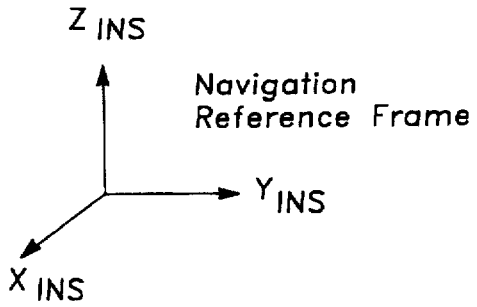
FIG. 3 is a depiction of an aircraft master reference frame.
Figure 4:
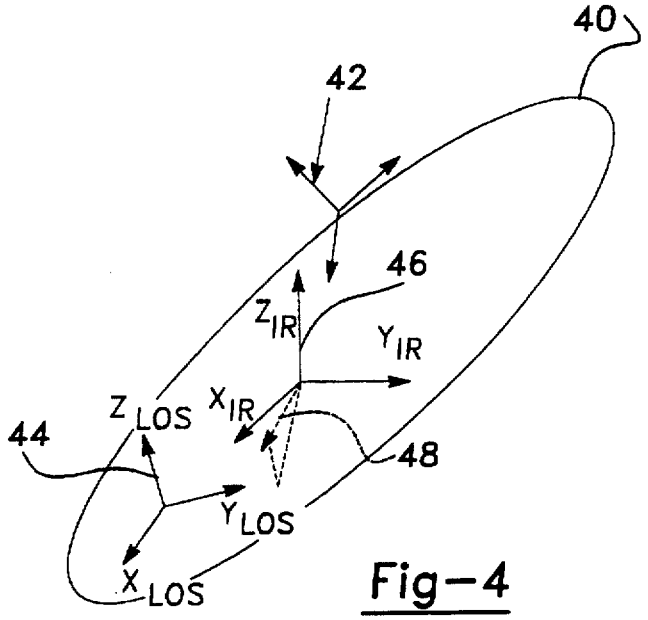
FIG. 4 is a depiction of a pod mounting reference frame, line-of-sight reference frame, and boresight alignment reference frame relative to a pod of FLIR system.
Figure 5:
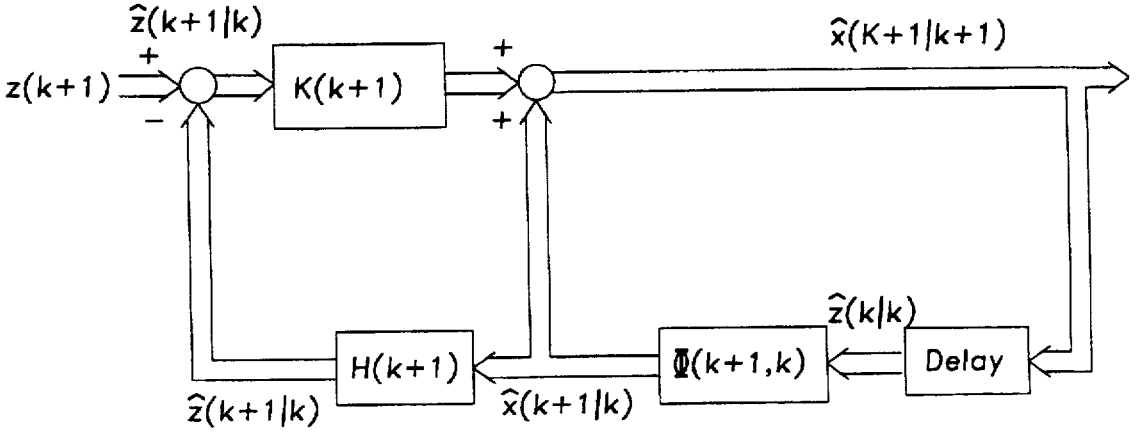
Fig-5 (Prior Art)
FIG. 5 is a block diagram of a known Kalman filter.

As is well understood in the art, Kalman filtering is a linear filtering technique that dates back to the original work as disclosed in Kalman, R. E., "A New Approach to Linear Filtering and Prediction Problems," Journal of Basic Engineering, March, 1960, pp. 35–45. A block diagram of a typical Kalman filter is shown in FIG. 5. The Kalman filter algorithm provides a recursive solution to the problem of finding a minimum variance estimate of the states of a linear system from a sequence of noisy measurements which are linear combinations of the states of that system. The initial covariance of the state estimation errors, and the covariance of the measurement and process noises are known. The measurements and process noise are assumed to be uncorrelated in time. Since apriori statistics are required, the Kalman filter is an example of a Bayesian Estimation Method, known to those skilled in the art.

The Kalman filter contains a model of the system to be estimated in a form of the state transition matrix $\Phi$. A prediction of the measurement z is differenced from the actual measurement to form a measurement residual error. The predicted measurement z is formed from the predicted state using a measurement matrix H. This residual error is multiplied by a gain K computed from the statistics of the random process and the measurements to minimize the variance of the state estimation error. This operation forms a correction to the predicted state x. The state correction is added to the predicted state to form an updated state. The Kalman filter, therefore, is a type of predictor-corrector algorithm. Numerous reference material is devoted to the theory of Kalman filtering in varying degrees of detail and complexity.

According to the invention, two transfer alignment approaches are utilized to align the pod LOS to the navigation reference frame. The pod INS system, according to the invention, located in the pod 20, can be transfer aligned to the aircraft INS system coordinates and/or to the aircraft GPS system coordinates. This transfer alignment occurs by "matching" the position and/or the velocity outputs of the pod INS against comparable outputs of a "reference INS" (the aircraft INS or GPS), in the presence of aircraft maneuvers. Attitude misalignments are estimated during this process as they create observable errors in the pod INS output, relative to the reference output. This estimation process is carried out using a navigational Kalman filter. In the case of transfer alignment to the aircraft INS, matching is done using position and/or velocity outputs and/or attitude output of the aircraft INS. Transfer alignment to GPS coordinates can similarly use matching to position/velocity GPS receiver outputs, which are referred to as a "cascaded" mechanism. This approach is referred to as the cascaded Kalman filter (CKF) approach.

Alternately, transfer alignment to GPS can use GPS pseudo range and delta-pseudo range outputs, which is referred to as a "direct" mechanism. This approach is referred to as a direct Kalman filter (DKF) approach. The cascaded approach is easier to implement, while the direct approach provides potentially better alignment accuracy and greater jam immunity for a ,given inertial measuring unit (IMU). In either example, the lever arm distance between the pod IMU reference point and the phase center of the GPS antenna must be corrected. If no GPS updates are available, the Kalman filter is used to transfer align the aircraft inertial reference unit to the pod inertial reference frame.

The source of the GPS data is either from an aircraft GPS or from a separate GPS receiver located in the pod 20. If the GPS receiver is located in the pod 20, GPS RF signals must be brought down to the pod 20 over a high bandwidth MIL-STD-1760 interface line. If the aircraft GPS receiver is used as the GPS data source, the cost of a separate receiver in the pod 20 is eliminated.

Figure 6:
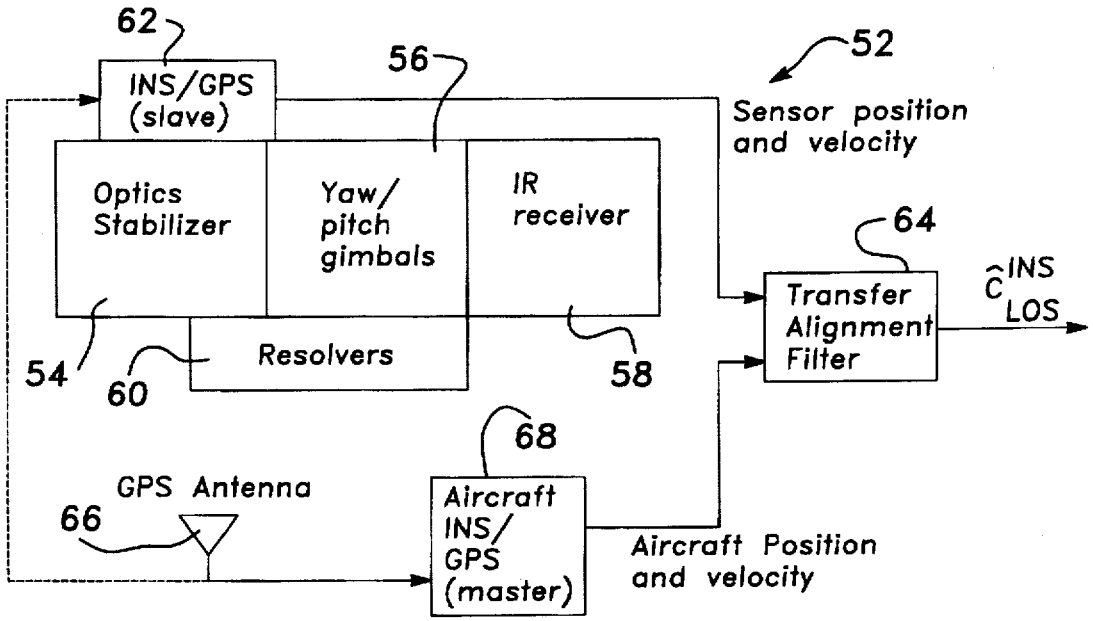
FIG. 6 is a process block diagram of a FLIR boresight alignment technique according to an embodiment of the present invention.

FIG. 6 shows a block diagram of a FLIR boresight alignment system 52 that either aligns a pod INS with an aircraft INS, or aligns a pod INS to a set of navigation frames using GPS inputs according to alternate embodiments of the present invention. The alignment system 52 includes an optics-stabilizer 54 including yaw and pitch gimbals 56 that provide inertial stability to the LOS of the pod 20. The optics-stabilizer 54 is intended to represent the optics-stabilizer 26 above. Likewise, an IR receiver 58 (sensor) is intended to represent the IR receiver 28, also discussed above. A set of resolvers 60 measure the motion of the pod yaw/pitch gimbals relative to the IR receiver 58.

A pod INS/GPS system 62 is secured within the pod 20, and is connected to the optics-stabilizer 54. The INS/GPS system 62 is a new feature not found in the prior art pod. The INS/GPS system 62 generates a pod position and velocity signal based on the pod LOS and the position of the yaw/pitch gimbals 56, and applies it to a transfer alignment filter 64. When acting as a CKF system, the position and velocity signal of the optics-stabilizer 54 is subtracted from the aircraft position and velocity to produce the input to the alignment filter 64.

A GPS antenna 66 receives GPS signals from a satellite network (not shown) to provide a signal indicative of the aircraft's position and velocity relative to the earth. The signals from the GPS antenna 66 are applied to an aircraft INS/GPS 68 that converts the signals received from the satellite by the antenna 66 into aircraft position and velocity data, in a manner that is well understood in the art. The aircraft INS/GPS 68 is currently provided on the aircraft 10 to provide aircraft position and velocity. This aircraft position and velocity output is then applied to the transfer alignment filter 64 so as to align the pod INS to the navigation reference coordinates.

For the DKF approach, the output of the GPS antenna 66 is also applied to the INS/GPS 62.

The cascaded Kalman filter operates on the position and velocity solutions produced by another Kalman filter in the GPS receiver. The position and velocity solutions produced by the pod INS system are subtracted from these outputs to produce measured position and velocity errors. These errors are multiplied by the Kalman gain matrix to produce a set of corrections to the predicted states of the filter. These states are typically position error, velocity error, attitude error, and some selected inertial measurement unit instrument errors such as gyro bias and accelerometer bias.

The direct Kalman filter operates upon the measured pseudo ranges and delta pseudo ranges to the satellites tracked by the GPS receiver. Based on the predicted position of the navigator and the position of the satellites computed from ephemeris data, the Kalman filter predicts the value of the pseudo ranges and delta pseudo ranges that are expected to be measured. These values are subtracted from the measurements actually received to produce a set of measurement residuals. These residuals are multiplied by the Kalman Gain Matrix to produce a set of corrections to the predicted states.

The Kalman filter produces a set of corrections to the position, velocity, and attitude of the pod INS system. These corrections are incorporated into the pod navigation solution in software so that the best estimate of the remaining error after correction is zero. The attitude corrections are fed into the quaternion calculation to correct the computed transformation matrix from sensor coordinates to navigation coordinates.

The INS of the pod consists of an inertial measurement unit (IMU) and a computer which mechanizes the strapdown navigation solution. The IMU contains three accelerometers and three gyroscopes which output the integral of specific force (inertial acceleration minus gravity) and angular velocity in sensor coordinates. The accelerometer outputs are coordinate transformed from sensor coordinates to navigation coordinates in software, compensated for gravity and coriolis acceleration, and integrated to produce position and velocity solutions. The outputs of the gyroscopes are used in software to compute the coordinate transformation from sensor coordinates to navigation coordinates. The accelerometers and gyroscopes of a strapdown system are attached directly to the pod body; there are no gimbals to isolate a stable member (which physically implements the navigation coordinates) from angular motions of the pod. Instead, the orientation of the sensor coordinates with respect to the navigation coordinates is computed in software. This type of mechanization saves the weight and complexity of the gimbal system and its supporting controllers.

Figure 7:
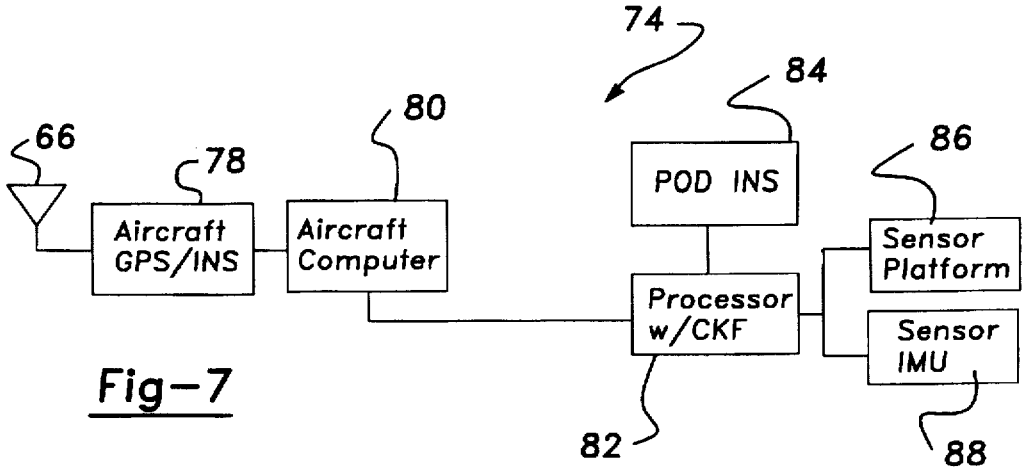
FIG. 7 is a block diagram of a cascaded Kalman filter for use in the boresight alignment technique of the invention.
Figure 8:
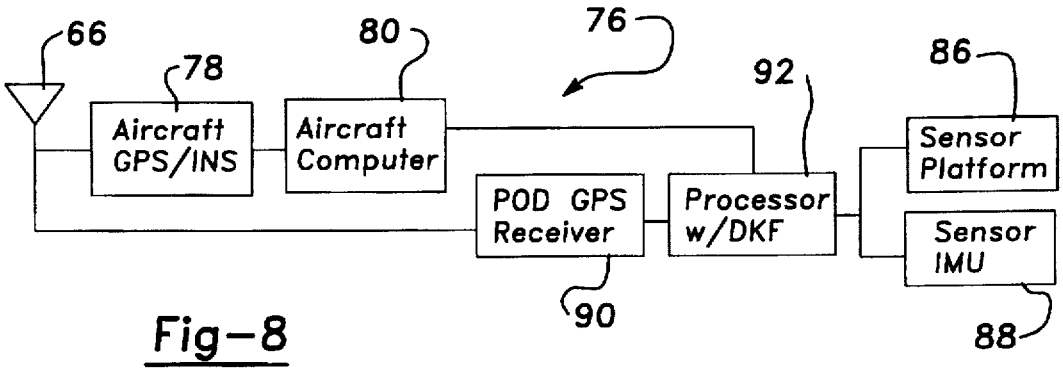
FIG. 8 is a block diagram of a direct Kalman filter to be used in the boresight alignment technique of the invention.
Figure 9:
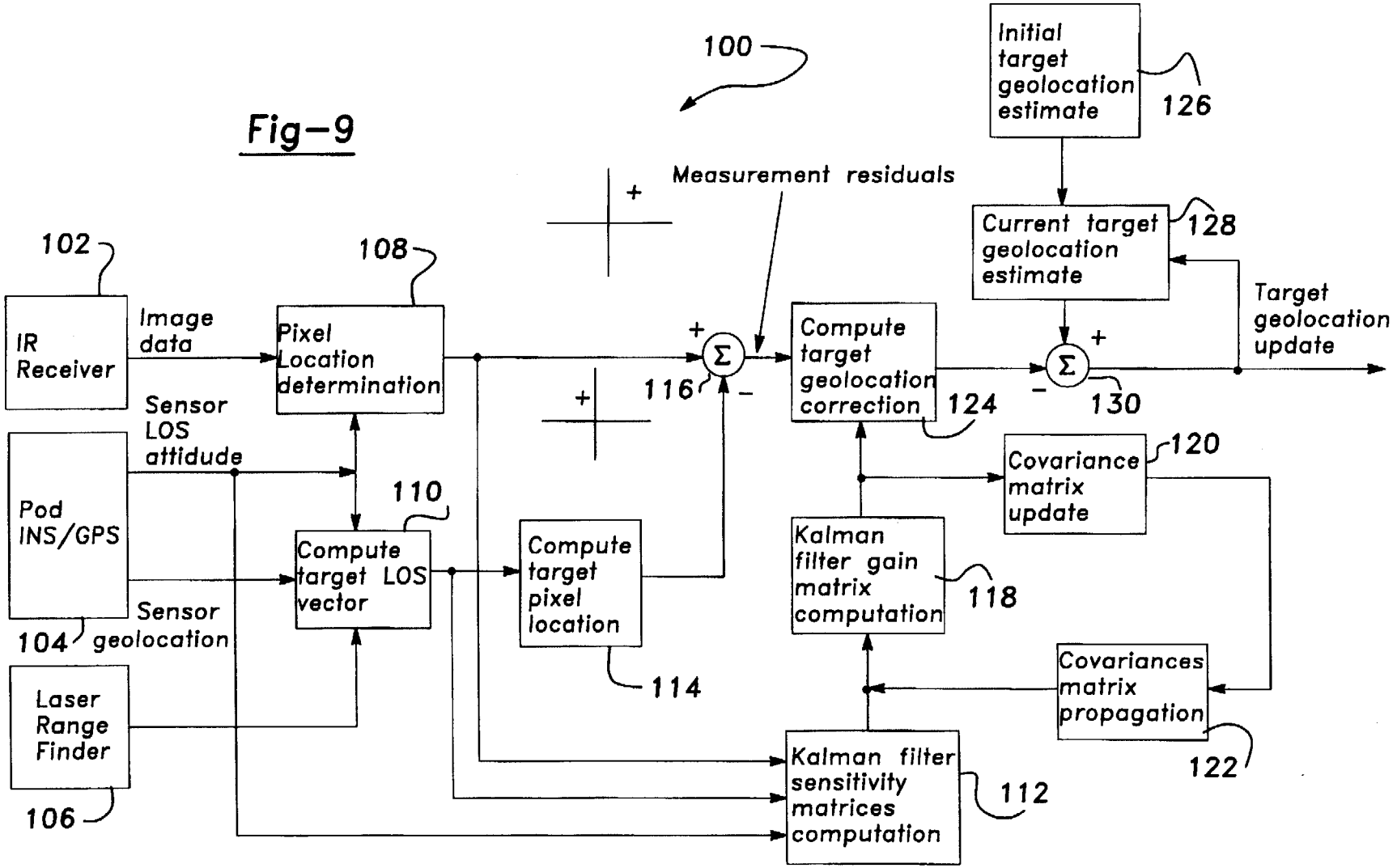
FIG. 9 is a block diagram of a Kalman filter algorithm for a multi-look target GEO location determination system of the invention.

FIGS. 7 and 8 depict a separate CKF system 74 and DKF system 76, respectively that operate as described above. The CKF system 74 and the DKF system 76 both depict the aircraft INS/GPS 68 as including an aircraft GPS/INS and an aircraft computer for calculating the aircraft position and velocity. For the CKF system 74, the transfer alignment filter 64 has been replaced with a processor 82 including a CKF. A pod INS 84 provides the position and velocity of the sensor to the processor 82. The difference between the sensor LOS position and velocity, and the aircraft position and velocity is applied to a sensor platform 86 and a sensor IMU 88. The sensor platform 86 represents the optics-stabilizer 54, the yaw/pitch gimbals 56 and the resolver 60.

For the DKF system 76, a GPS receiver 90 represents the INS/GPS system 62 and a processor 92 including a DKF represents the transfer alignment filter 64.

The alignment error to be minimized is that misalignment between the pod LOS and the navigation reference frame. Since the transfer alignment process can only calibrate the alignment between the sensor IMU axes 88 and the navigation reference frame, it is desired to minimize the number of interfaces that are outside of that process. The IMU can be located in a number of different locations in the pod 20. Ideally, the IMU 88 is located on a gimbal as close to the FLIR optic stabilizer 54 as possible. This mounting will minimize the amount of mechanical misalignment between the IMU reference axes and the telescope boresight, which cannot be reduced by transfer alignment. The IMU 88 could also be located in the pod 22 off gimbal, but such a mounting is less desirable as the errors in the gimbal readouts and the gimbal misalignment errors are introduced.

The accuracy of the transfer alignment is largely determined by IMU error sources. The flexure of the fuselage 16 and the wings 14, and vibration of the aircraft 10 degrade accuracy by introducing additional measurement noise into the estimation process. The degree of observability of alignment errors depend on the form of the aircraft maneuver performed during the transfer alignment. Preliminary studies have assumed the use of a standard ±0.5 g "S-maneuver" by the aircraft 10. Initial results verify the feasibility of performing the transfer alignment to 1 milli-radian accuracy with a DKF approach. Table I below shows the assumed allocation of the total alignment error to the three primary elements.

TABLE I

| Error Source | Level (EL) Error (micro-radians) | Azimuth (AZ) Error (micro-radians) |
|---|---|---|
| GPS/INS Navigation Alignment | 915 | 915 |
| IMU-to-Sensor Alignment | 400 | 400 |
| Sensor Noise | 40 | 40 |
| RSS Total | 1000 | 1000 |

Sensitivity analysis indicates that the required accuracy of the IMU 88 be similar to the values defined in Table II below.

TABLE II

| IMU Error Source | Requirement (1sigma) | unit |
|---|---|---|
| Gyro Bias | 3 | deg/hr |
| Gyro Bias Stability (tau = 120 sec) | 1 | deg/hr |
| Gyro Scale Factor | 500 | ppm |
| Gyro Random Walk | 0.3 | deg/rt-hr |
| Accelerometer Bias | 2 | milli-g |
| Accelerometer Bias Stability (tau = 120 sec) | 0.5 | milli-g |
| Accelerometer Scale Factor | 2000 | ppm |
| Accelerometer Cross-Axis Sensitivity | 500 | ppm |

In addition to providing target information for conventional weapons delivery, such as unguided bombs, it is desirable to add the capability to the existing pod 20 to support guided weapon systems. For a GPS guided weapon, such as joint direct attract munition (JDAM), a precise target geolocation must be determined in order to minimize the target impact in missed distance. In principle, weapon impact circular error probable (CEP) requirements drive the target location accuracy requirements. CEP includes weapons guidance and navigation errors, and target location errors. The absolute position error of the aircraft 10 is not important if the targeting is ownship. The ownship error cancels in the calculation of the position of the weapon relative to the target. Ownship position error becomes relevant in the case of the pod locating the target for a different launch aircraft. In this case, the difference in position error between the designating party and the launching party would contribute directly to the relative position error between the weapon and the target.

At each observation, the target geolocation determination accuracy is a function of target range error and target LOS angle errors. However, if a multiple look at the target is possible, then a Kalman filter including target position as states can be implemented to improve the target CEP performance, since the random noise or high frequency components of range error and target LOS angle errors can be averaged out during the multi-look operation. Some components of IR sensor boresight to IMU sensor misalignment are observable from changes in the LOS angles to the target.

FIG. 8 depicts a block diagram of a multiple look operation system 100 using an "averaging out" where measurement residuals, i.e., the difference between the current measured target azimuth/elevation (AZ/EL) angles and the computed target AZ/EL angles based on the previous target location estimate, are computed at every successive observation. The multiple look operation system 100 includes an IR receiver (sensor) 102 and a pod INS/GPS 104 intended to represent the IR receiver 58 and the INS/GPS 62, respectively. A laser range finder 106, which may be positioned within the pod 20 or elsewhere, provides target distance from the aircraft 10. The IR receiver 102 provides image data to a pixel location determination system 108. Additionally, the sensor LOS attitude determined by the pod INS/GPS 104 is applied to the pixel location determination system 108, a target LOS vector compute system 110, and a Kalman filter sensitivity matrices computation system 112. Further, the sensor geolocation in X, Y and Z coordinates is also applied to the target LOS vector system 110 along with a signal of the distance to the target as determined by the laser range finder 106.

The location of the target in the image from the IR receiver 102 is determined by the location determination system 108. The output of the location determination system 108 is the measured target AZ/EL angles in the IR receiver coordinate frame. The LOS vector computation 110 determines the computed location of the target based on the sensor LOS attitude, sensor geolocation, and target range information. The target pixel location compute system 114 determines the computed target AZ/EL angles in IR receiver coordinates. The measured target AZ/EL angles and the computed target AZ/EL angles are then applied to a summation device 116 to determine the residuals between these angles. The measurement residuals are the azimuth angle differences and the elevation angle differences.

Kalman filtering is performed by a Kalman filter gain matrix computation system 118 based on the sensitivity matrices from the system 112. The Kalman filtering technique uses covariance matrix updates calculated by a covariance matrix update system 120 and covariance matrix propagation calculated by a covariance matrix propagation system 122, as shown. The output from the Kalman computations from the system 118 is then applied to a geolocation correction system 124 that computes the target geolocation correction based on the Kalman filtering computation and the measurement residuals. The target geolocation estimate is determined by an initial target geolocation estimate system 126 and a current target geolocation estimate system 128. The target geolocation estimate and the computed target geolocation correction are both applied to a summation device 130 to provide the target geolocation update.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A boresight alignment system for aligning an optical sensor boresight to a navigation reference frame associated with an aircraft, said system comprising:

a pod secured to the aircraft, said optical sensor being positioned within the pod;

a pod inertial navigation system positioned in the pod and providing signals of the position and velocity of the pod;

an aircraft inertial navigation system positioned on the aircraft and being separate from the pod, said aircraft inertial navigation system providing signals of the position and velocity of the aircraft; and a transfer alignment filter, said transfer alignment filter being responsive to the position and velocity signals from both the pod inertial navigation system and the aircraft inertial navigation system and providing a signal to the pod of a difference in attitude between pod INS coordinates from the pod position and velocity signals and reference navigation coordinates from the aircraft position and velocity signals.

2. The system according to claim 1 wherein the transfer alignment filter includes a cascaded Kalman filter utilizing a plurality of cascaded Kalman filters to provide the difference in attitude between the pod INS coordinates and the reference navigation coordinates.

3. The system according to claim 1 wherein the pod includes an optics stabilizer, said optics stabilizer stabilizing the sensor and being responsive to the output of the transfer alignment filter.

4. The system according to claim 1 further comprising an inertial measurement unit, said inertial measurement unit including a plurality of accelerometers that generate position and velocity solutions and a plurality of gyroscopes that compute coordinate transformations from the pod coordinates to the navigation coordinates.

5. The system according to claim 1 further comprising a mission control computer, said mission control computer controlling the alignment between the sensor boresight and the navigation reference frame.

6. The system according to claim 1 wherein the sensor is an infrared sensor.

7. A boresight alignment system for aligning an optical sensor boresight to a set of navigation coordinates, said alignment system being associated with an aircraft, said system comprising:

a pod secured to the aircraft, said optical sensor being positioned within the pod;

a pod global positioning system (GPS) and inertial navigation system (INS), said pod GPS and INS providing a signal indicative of the position and velocity of the pod;

an aircraft GPS and INS positioned on the aircraft and being separate from the pod, said aircraft GPS and INS providing a signal indicative of the position and velocity of the aircraft; and a transfer alignment filter, said transfer alignment filter being responsive to the signal of the position and velocity of the pod from the pod GPS and INS system and the signal of the position and velocity of the aircraft from the aircraft GPS and INS, said transfer alignment filter providing a signal of the difference between the position and velocity signals.

8. The system according to claim 7 wherein the transfer alignment filter includes a direct Kalman filter that utilizes pseudo range and delta-pseudo range GPS outputs.

9. The system according to claim 7 wherein the transfer alignment filter includes a cascaded Kalman filter utilizing a plurality of cascaded Kalman filters to provide the difference between the position and velocity signals.

10. The system according to claim 7 further comprising an optics stabilizer, said optics stabilizer stabilizing the sensor and being responsive to the output of the transfer alignment filter.

11. The system according to claim 7 further comprising an inertial measurement unit, said inertial measurement unit including a plurality of accelerometers that generate position and velocity solutions and a plurality of gyroscopes that compute coordinate transformations from pod coordinates to navigation coordinates.

12. The system according to claim 7 further comprising a single aircraft GPS antenna, said aircraft GPS antenna providing radio frequency GPS signals to the pod GPS and INS and the aircraft GPS and INS.

13. A boresight alignment system for aligning an optical sensor boresight to a reference frame, said system comprising:

a first structure, said first structure including the optical sensor, said first structure further including a first inertial navigation system positioned on the structure and providing signals of the position and velocity of the structure;

a second structure, said second structure including a second inertial navigation system positioned on the second structure and being separate from the first structure, said second inertial navigation system providing signals of the position and velocity of the second structure; and a transfer alignment filter, said transfer alignment filter being responsive to the position and velocity signals from both the first inertial navigation system and the second inertial navigation system and providing a signal to the first structure of the difference in attitude between the first structure and the second structure.

14. The system according to claim 13 wherein the second structure is an aircraft and the first structure is a pod secured to the aircraft.

15. The system according to claim 13 wherein the transfer alignment filter includes a Kalman filter for providing Kalman filtering of the position and velocity signals from both the first inertial navigation system and the second inertial navigation system in order to generate an error signal between the signals.

16. The system according to claim 15 wherein the Kalman filter is a cascaded Kalman filter utilizing a plurality of cascaded Kalman filters to provide the difference in attitude between inertial navigation system coordinates and reference navigation coordinates.

17. The system according to claim 13 wherein the first structure includes a first global positioning system and the second structure includes a second global positioning system.

18. The system according to claim 17 wherein the transfer alignment filter includes a direct Kalman filter that utilizes pseudo range and delta-pseudo range global positioning system outputs from the pod global positioning system and the aircraft global positioning system.

19. A method of aligning an optical sensor boresight to a set of navigation coordinates for an aircraft, said method comprising the steps of:

providing a pod secured to the aircraft in which the optical sensor is positioned within the pod;

providing a pod global positioning system and inertial navigation system;

using the pod global positioning system and inertial navigation system to provide signals indicative of the position and velocity of the pod;

providing an aircraft global positioning system and inertial navigation system positioned on the aircraft and separate from the pod;

using the aircraft global positioning system and inertial navigation system to provide signals indicative of the position and velocity of the aircraft;

providing a transfer alignment filter that is responsive to the signals from the pod global positioning system and inertial navigation system and the aircraft global positioning system and the inertial navigation system; and using the transfer alignment filter to provide a difference between the position and velocity signals.

20. The method according to claim 19 wherein the step of providing a transfer alignment filter includes providing a transfer alignment filter having a direct Kalman filter that utilizes pseudo range and delta-pseudo range global positioning system outputs.

21. The method according to claim 19 wherein the step of providing a transfer alignment filter includes providing a transfer alignment filter having a plurality of cascaded Kalman filters to provide the difference between the position and velocity signals.

* * * * *